US010206438B2

(12) United States Patent
Levy

(10) Patent No.: US 10,206,438 B2
(45) Date of Patent: Feb. 19, 2019

(54) INSULATED GARMENT, INSULATING AND WICKING FEATURE AND METHOD

(76) Inventor: Jonathan A. Levy, Great Neck, NY (US)

( * ) Notice: Subject to any disclaimer, the term of this patent is extended or adjusted under 35 U.S.C. 154(b) by 253 days.

(21) Appl. No.: 12/925,338

(22) Filed: Oct. 18, 2010

(65) Prior Publication Data

US 2011/0214217 A1 Sep. 8, 2011

Related U.S. Application Data

(60) Provisional application No. 61/252,590, filed on Oct. 16, 2009.

(51) Int. Cl.

| | |
|---|---|
| ***A41D 13/05*** | (2006.01) |
| ***A41D 13/00*** | (2006.01) |
| ***B65D 85/18*** | (2006.01) |

(52) U.S. Cl.

CPC ..... *A41D 13/05* (2013.01); *A41D 13/00* (2013.01); *B65D 85/18* (2013.01); *A41D 2400/20* (2013.01)

(58) Field of Classification Search

CPC ..... A41D 13/05; A41D 2400/20

USPC ..... 2/115, 455

See application file for complete search history.

(56) References Cited

U.S. PATENT DOCUMENTS

| | | | | |
|---|---|---|---|---|
| 4,680,813 | A * | 7/1987 | Glaeser | 2/459 |
| 5,792,714 | A * | 8/1998 | Schindler et al. | 442/194 |
| 5,978,965 | A * | 11/1999 | Summers | 2/69 |
| 6,014,771 | A * | 1/2000 | Kirven | 2/23 |
| 7,913,319 | B1 * | 3/2011 | Iannace | 2/24 |

* cited by examiner

*Primary Examiner* — Katherine Moran

(74) *Attorney, Agent, or Firm* — Lawrence J. Wechsler; Wechsler & Wechsler, P.C.

(57) ABSTRACT

A garment includes a garment body formed of at least one fabric. At least one padded portion is coupled to the garment body so as to extend inwardly of the garment body and at least partially occupy a volume defined by a space between a portion of the garment body and a correspondingly positioned portion of a wearer's body. A method includes disposing padding configured to be accommodated in a region of a body of the wearer which is spaced apart from a portion of a garment body of the exercise garment when worn so as to be inwardly projecting of the garment body in a position generally corresponding to the region of the body of the wearer, to thereby insulate and/or wick moisture away from the skin.

19 Claims, 1 Drawing Sheet

INSULATED GARMENT, INSULATING AND WICKING FEATURE AND METHOD

CROSS REFERENCE TO RELATED APPLICATIONS

This application claims the benefit of U.S. Provisional Application No. 61/252,590 filed Oct. 16, 2009 entitled INSULATED GARMENT, INSULATING AND WICKING FEATURE AND METHOD.

BACKGROUND OF THE INVENTION

The present invention relates to a garment, and more particularly, to a garment including a feature which provides improved protection against exposure to ambient conditions during outdoor activities, for increased comfort and security of the user.

The curvature of the human body, for both male and female, presents a natural tendency for articles of wear to be spaced apart from the skin in certain locations therealong. For example, at the small of the back, or between the pectoral region, a gap is present between the skin of a wearer and fabric comprising a body of a garment. Air occupying this space is quickly cooled to ambient temperature in cold weather, which chills the wearer of such garment in these areas in cold weather conditions, exacerbated by moisture on the skin due to accumulated perspiration. Conversely, in warm weather, perspiration in these regions not in contact with the garment fabric, is not wicked away from the body as in other locations, thereby inhibiting comfort during exercise.

Heretofore, no suitable steps have been taken to address the above problem, to provide a wearer of an exercise garment with a comfortable workout experience, or outdoor workers, for example, to conserve heat comfortably, enabling the users to remain warm in cold weather and dry and cool in warm conditions.

It is therefore an object of the invention to provide a garment having a feature which overcomes the drawbacks of the prior art, discussed, inter alia, above.

SUMMARY OF THE INVENTION

In accordance with this and other objects of the invention, an embodiment of the invention includes a garment, for example an exercise jersey, the body of which is formed of at least one fabric, for example typical stretchable fabric(s) designed to fittably conform to a wearer's upper torso, which includes an additional feature comprising an interior padded portion which extends between the garment body and a recessed body region not in direct contact therewith. Generally, these recessed regions would be any body feature located between adjacent regions that protrude further than the recessed region, and which thereby form a tensioned web of fabric therebetween, over the recessed region.

The padded region or regions are configured to at least partially fill the open volume between the fabric web portion and the recessed body portion, to effectively contact the recessed body portion otherwise exposed to the air in the open volume, which is chilled by the ambient conditions during cold weather workouts, and which results in an uncomfortable experience, further exacerbated by the fact that perspiration is not wicked from the skin in these locations, as it is in places of fabric-to-body contact.

Material for the padding comprising the padded regions advantageously, though not necessarily, comprises a hydrophilic material having characteristics which provide superior capillary pressure and low water absorption, such as for example, polyester, polypropylene and microfiber-based fabrics. It is believed that the two properties effecting wicking performance in a fabric are capillary pressure and permeability. Capillary pressure is thought to be the major force responsible for movement of moisture through a fabric. Permeability is expressive of the ability to transport moisture through the fabric, and is determined by a combination of sizes of spaces within it and the connections between the spaces. How the fibers are configured (yarn twist) and arranged (knit or weave) and other factors will be considered in selecting an appropriate material for use as all or part of the padding. In this context, it is contemplated that the padding need not be a unitary body, but can alternatively be comprised of layers or aggregates of same or different material to enhance wicking, comfort and/or insulation.

The above, and other objects, features and advantages of the present invention will become apparent from the following description read in conjunction with the accompanying drawings.

DETAILED DESCRIPTION OF THE PREFERRED EMBODIMENT

Figure 1:
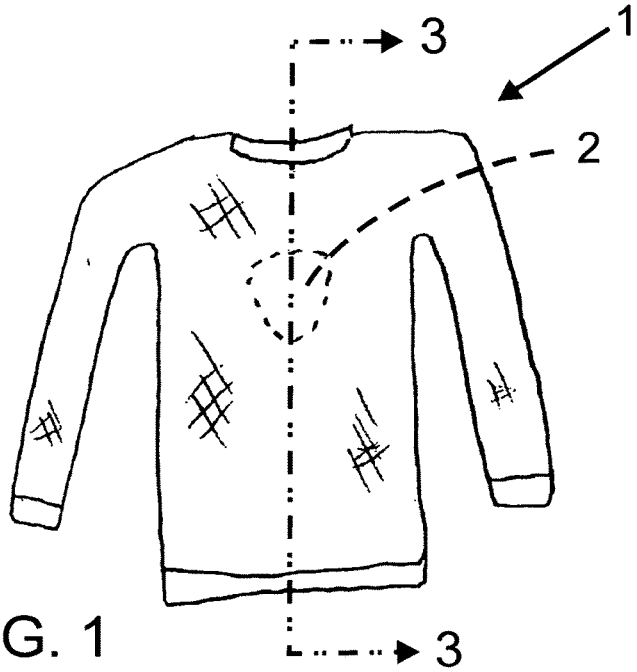
FIG. 1 is a front view of an exercise garment according to an embodiment of the invention directed to the example of a jersey.
Figure 2:
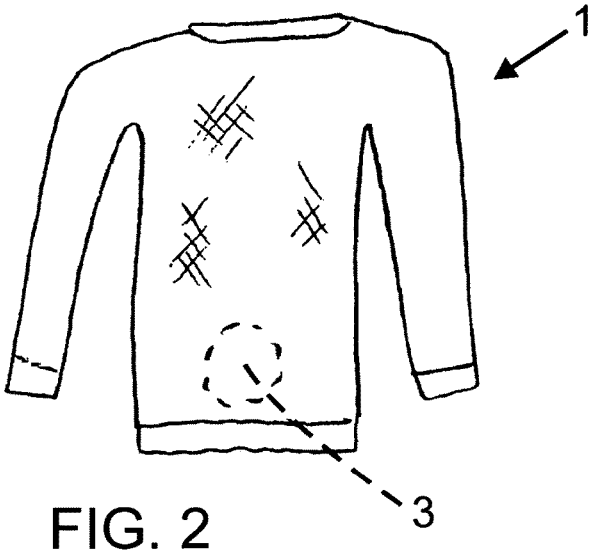
FIG. 2 is a rear view of the exercise garment of FIG. 1.
Figure 3:
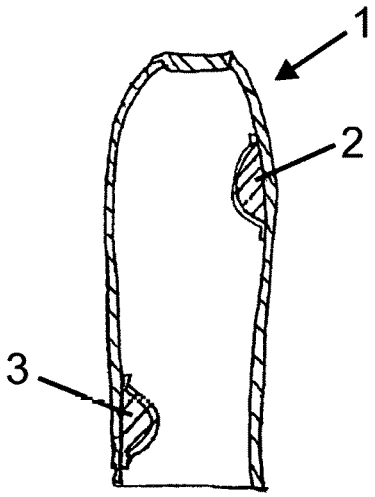
FIG. 3 is a cross sectional view taken along line 3-3 in FIG. 1.

Referring now to the figures, a representational embodiment using the example of an exercise jersey 1 is depicted. A body of the jersey 1 is comprised of a suitable fabric, for example, of conventionally used material, advantageously being elastic and possessing desirable insulating and water wicking characteristics. A first padded portion 2, corresponding to a hollow at the center of the chest between the pectoralis major (pectoral regions) is shown by the broken lines in FIG. 1, and a second padded portion 3, corresponding to the central hollow at the lower back between the latissimus dorsi (lats) shown by the broken lines in FIG. 2, as being disposed to be inward facing of the jersey 1. The inward extending nature of each of the first and second padded portions 2 and 3 is illustrated, in cross-section, in FIG. 3.

Padded portions 2 and 3 are fastened to the fabric body of jersey 1 by any suitable means practiced in the textile arts, for example, by stitching and/or gluing. The padded portions may be permanently affixed to the fabric body, or removably affixed, such as by use of VELCRO or other similar system, the latter approach to allow custom placement of the padded portions to positionally match the specific anatomy of a particular user. In addition, supply of individual padded units (packets) of different shapes and sizes in kits or the like to users, advantageously allows selection by the user of the most appropriate padded unit at a time of use for installation to a garment.

A heat reflective layer which advantageously retains vapor permeability, particularly in a region of the padded portions 2 and 3, can optionally be provided at a distance away from the body contact part of the padding, which acts to reflect body heat back to the user, and specifically adapted to use in a cold weather setting. The heat reflective layer could be provided in the form of conventionally used materials, such a metallic threads interwoven with the remaining fabric, or like measures taken.

While the example disclosed above is directed specifically to an exercise garment, the invention will find application to thermal shirts and the like worn by outdoorsmen and workers, and the principles discussed herein are applicable by analogy.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims. For example, pants could be provided, within the contemplated scope of the invention, with suitable padded regions in areas in which fabric is spaced apart from the skin of a user, for example, at the back of the legs at the bend of the knees.

What is claimed is:

1. A method of providing enhanced comfort to a wearer of a garment, comprising:

providing the garment which includes a garment body which when worn by the wearer creates a hollow space between at least one region of the garment body and at least one anatomically recessed region of a body of the wearer, the hollow space being located between adjacent body regions that protrude further than the at least one anatomically recessed region of the wearer;

providing padding corresponding to said at least one anatomically recessed region of the body of the wearer;

disposing the padding within said at least one region of the garment body, said padding being positioned to be inwardly projecting of the garment body to at least partially occupy said hollow space, said padding being confined to said hollow space corresponding to each said at least one anatomically recessed region such that another region adjacently surrounding said hollow space remains unpadded; and placing the garment on the body of the wearer such that said padding at least partially occupies said hollow space between the at least one region of the garment body and the at least one anatomically recessed region of the body of the wearer.

2. A method according to claim 1, further comprising outwardly wicking perspiration from the at least one anatomically recessed region of the body of the wearer which is in contact with the padding by selecting a material which is hydrophilic to comprise the padding.

3. A method according to claim 1, wherein the enhanced comfort includes at least one of insulation against ambient temperature or wicking of perspiration away from the body of the wearer by virtue of contact of the at least one padded portion with the body of the wearer in said at least one anatomically recessed region.

4. A method according to claim 1, wherein said padding is provided as at least one padded portion.

5. A method according to claim 1, wherein said at least one anatomically recessed region includes at least one of a hollow at a center of a chest of the wearer between the pectoralis major or a central hollow at a lower back between the latissimus dorsi.

6. A method according to claim 1, wherein:

said garment body in said at least one region defines a web of fabric extending over the at least one anatomically recessed region; and said web of fabric is spaced apart from the at least one anatomically recessed region.

7. A garment, comprising:

a garment body comprised of at least one fabric, said garment body being adapted to be worn by a wearer such that a hollow space is present between at least one region of the garment body and at least one anatomically recessed region of the wearer when the at least one fabric of the garment body is tensioned between adjacent body regions that protrude further than the at least one anatomically recessed region; and at least one padded portion coupled to said garment body and positioned within said at least one region so as to extend inwardly of the garment body and at least partially occupy the hollow space, each said at least one padded portion being confined to said hollow space corresponding to each said at least one anatomically recessed region, another region of said garment body adjacently surrounding said hollow space remaining unpadded.

8. A garment according to claim 7, wherein the garment body comprises an exercise jersey.

9. A garment according to claim 7, wherein the at least one padded portion comprises a hydrophilic material having characteristics which provide at least one of effective capillary pressure or low water absorption.

10. A garment according to claim 9, wherein the hydrophilic material includes at least one of polyester, polypropylene or microfiber-based fabrics.

11. A garment according to claim 7, wherein said at least one anatomically recessed region includes at least one of a hollow at a center of a chest of the wearer between the pectoralis major or a central hollow at a lower back between the latissimus dorsi.

12. A garment according to claim 7, wherein said at least one padded portion includes characteristics providing at least one of insulation against ambient temperature or wicking of perspiration away from the wearer's body.

13. A garment according to claim 7, wherein said at least one padded portion is fastened to the garment body by at least one of stitching or gluing.

14. A garment according to claim 7, wherein said at least one padded portion is removably fastened to the garment body.

15. A garment, comprising:

a garment body comprised of at least one fabric, said garment body being adapted to be worn by a wearer such that an open volume containing air is created between at least one region of the garment body and at least one anatomically recessed region located between adjacent body regions when the at least one fabric of the garment body extends between the adjacent body regions when the garment is worn; and at least one padded portion carried on said garment body being positioned within said at least one region of the garment body so as to extend inwardly of the garment body and at least partially occupy the open volume, each said at least one padded portion being confined to each said at least one anatomically recessed region, other regions of the garment body corresponding to said adjacent body regions when the garment is worn by the wearer remaining unpadded.

16. A garment according to claim 15, wherein said at least one fabric includes at least one type of stretchable fabric designed to fittably conform to an upper torso of the wearer.

17. A garment according to claim 15, wherein the at least one padded portion is one of a padded unit or is comprised of layers or aggregates of same or different material to enhance at least one of wicking, comfort or insulation.

18. A garment according to claim 15, wherein a side of said padded portion facing inward and away from the garment body is adapted to contact the body of the wearer in said anatomically recessed region when the garment is worn by the wearer.

19. A garment according to claim 15, wherein said at least one padded portion has a thickness which decreases from a central region to a periphery.

* * * * *